United States Patent [19]

McClure

[11] Patent Number: 4,557,481

[45] Date of Patent: Dec. 10, 1985

[54] ARM WRESTLING TABLE

[76] Inventor: Randy L. McClure, 812 Wood St., Eldon, Iowa 52554

[21] Appl. No.: 676,853

[22] Filed: Nov. 30, 1984

[51] Int. Cl.[4] ..... A63B 21/02

[52] U.S. Cl. ..... 273/1 GC; 272/901; 273/1 GI

[58] Field of Search ..... 273/1 GC, 1 GI; 272/901, 902, 67; D21/195, 199

[56] References Cited

U.S. PATENT DOCUMENTS

| | | | |
|---|---|---|---|
| 254,747 | 4/1980 | O'Meara . | |
| D. 261,294 | 10/1981 | Clink et al. | 272/901 X |
| 3,735,983 | 5/1973 | Ortiz | 273/1 GC |
| 4,131,275 | 12/1978 | Gandy et al. | 272/901 X |
| 4,162,068 | 7/1979 | Berg | 273/1 GC |
| 4,220,330 | 9/1980 | Montgomery | 273/1 GC |
| 4,327,910 | 5/1982 | Mackie | 273/1 GI |
| 4,427,194 | 1/1984 | Dion | 273/1 GI X |
| 4,463,949 | 8/1984 | McCoy et al. | 273/1 GI |

OTHER PUBLICATIONS

Pat. No. 3,467,376 to Feinberg-*Official Gazette,* pp. 885–886, dated 9–16–69.

Pat. No. 3,672,741 to Clark-*Official Gazette* pp. 1435, dated 6–27–72.

Pat. No. 3,743,284 to Rhodes et al.-*Official Gazette* p. 200 dated 7–3–73.

4 (four) photographs of The Monster Arm Wrestling Machine.

*Primary Examiner*—Paul E. Shapiro

*Attorney, Agent, or Firm*—Henderson & Sturm

[57] ABSTRACT

An arm wrestling apparatus having an elevated frame with a first end and second end, a first side and a second side. Elbow pads are provided towards opposite corners of the apparatus and targets are provided on the frame diagonally across from each other on the corners not having the elbow pad structures thereon. This arrangement of the elbow pads and targets for winning cause the loser's arm to be bent in a natural direction, as contrasted with the direction of bending in conventional arm wrestling. Vertical and lateral adjusting mechanisms are provided for the elbow pads for accommodating the physical differences in dimensions for people's arms. Also, the positions of the elbow pads and targets can be shifted around the table to accommodate either a left or a right hand contest. Seats are provided for each contestant and mechanisms are provided for vertically adjusting the seats to accommodate various sizes of contestants for the purpose of equalizing the contest. Also, a mechanism is provided for adjusting the distance of the seat from each respective end of the table. An electrical circuit including numerous switches are provided to indicate the winner, and to detect cheating.

4 Claims, 13 Drawing Figures

ARM WRESTLING TABLE

TECHNICAL FIELD

The present invention relates to an arm wrestling machine and more particularly to an arm wrestling machine for preventing injury to arm wrestling contestants, for electrically indicating the winner of the contest, for indicating fouls in the contest, and for adjusting to the size of individual contestants so that certain contestants do not have an unfair advantage because of their physical dimensions.

BACKGROUND ART

People have engaged in various forms of arm wrestling for centuries. A classic form of arm wrestling involves two people seated across a short table with their elbows disposed upon the table directly across from one another and having hands grasping the other person's hand and with the arms disposed upwardly towards the hands in a vertical direction. Once the contest begins, the first person to push the other person's hand backwardly onto the table is declared the winner.

One of the problems with this classic form of arm wrestling is that sometimes the losers arm is bent downwardly in a direction in which it is not intended to bend, thereby causing injury and sometimes even broken arm bones to the loser. Another problem associated with classic arm wrestling is that one person may have a physical advantage over the other because of the length of the arm from the elbow to the hand. The person with such an arm longer than his opponent will have an advantage because such person with the longer arm will have more leverage and will be pushing down from above. Similarly, the person who is longer from the waist up to the shoulders than his opponent will have an advantage over his opponent because he will be able to exert a force from the shoulders above his opponent and more easily push such opponent's hand downwardly.

Two of the basic rules for classic arm wrestling are that each contestant must keep his elbow on the table during the contest and he must remain seated during the contest. The reasons for these rules are because that a person whose elbow is lifted off of the table can push downwardly and have more leverage against his opponent who has his elbow on the table. Similarly, a person who stands up to some extent, thereby lifting his shoulders higher, also gains an unfair advantage because he then can push downwardly against his opponent whereas the contest is designed to be one of strictly arm strength.

Arm wrestling tables such as U.S. Pat. No. Des. 254,747 to O'Meara have been devised for such contests, but they do not overcome all of the aforementioned problems. Similarly, mechanical arm wrestling machines have been developed wherein contestants try to push against levers which are mechanically hooked together. Buch such mechanical machines do not solve the aforementioned problems and they move away from classic arm wrestling, which has so much more appeal to most people, both from a spectator's point of view and a participation point of view.

Accordingly, there is a need for an arm wrestling apparatus which will be safe for contestants, which can be adjusted to equalize the contest and which can readily detect cheating by one contestant or the other.

DISCLOSURE OF THE INVENTION

The present invention relates to an arm wrestling apparatus having an elevated frame with a first end and second end, a first side and a second side. Elbow pads are provided towards opposite corners of the apparatus and targets are provided on the frame diagonally across from each other on the corners not having the elbow pad structures thereon. This arrangement of the elbow pads and targets for winning cause the loser's arm to be bent in a natural direction, as contrasted with the direction of bending in conventional arm wrestling.

Vertical and lateral adjusting mechanisms are provided for the elbow pads for accommodating the physical differences in dimensions for people's arms. Also, the positions of the elbow pads and targets can be shifted around the table to accommodate either a left or a right hand contest. Seats are provided for each contestant and mechanisms are provided for vertically adjusting the seats to accommodate various sizes of contestants for the purpose of equalizing the contest. Also, a mechanism is provided for adjusting the distance of the seat from each respective end of the table. An electrical circuit, including numerous switches, are provided to indicate the winner, and to detect cheating.

An object of the present invention is to provide an improved arm wrestling apparatus.

Another object of the invention is to provide an arm wrestling apparatus which prevents injury to arm wrestling contestants.

Another object of the invention is to provide an arm wrestling apparatus which has various adjustments to equalize the contest despite variations in the physical dimensions of the contestants.

Another object of the invention is to detect cheating in a clear objective manner so that referees are not necessary for this function.

Other objects, advantages, and novel features of the present invention will become apparent from the following detailed description of the invention when considered in conjunction with the accompanying drawings.

BEST MODE FOR CARRYING OUT THE INVENTION

Figure 1:
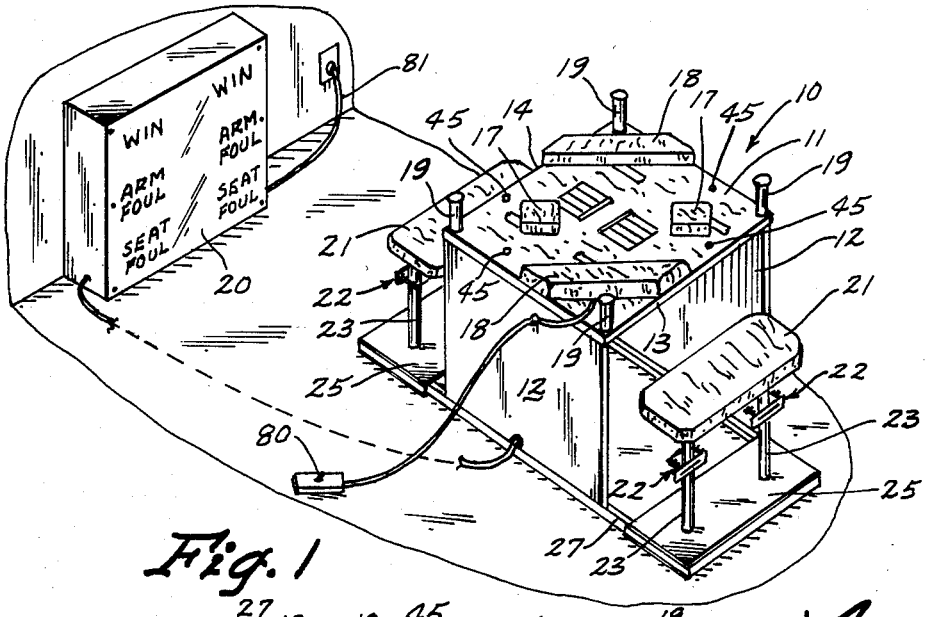
FIG. 1 is a perspective view of a preferred embodiment of the arm wrestling apparatus constructed in accordance with the present invention.

Referring now to the drawings wherein like reference numerals designate the identical or corresponding parts throughout the several views, FIG. 1 shows an arm wrestling apparatus (10) constructed in accordance with the present invention. The arm wrestling apparatus (10) includes a frame (11) held up off of the floor by support members (12). The frame (11) has a first end (13) a second end (14), a first side (15) and a second side (16).

Figure 2:
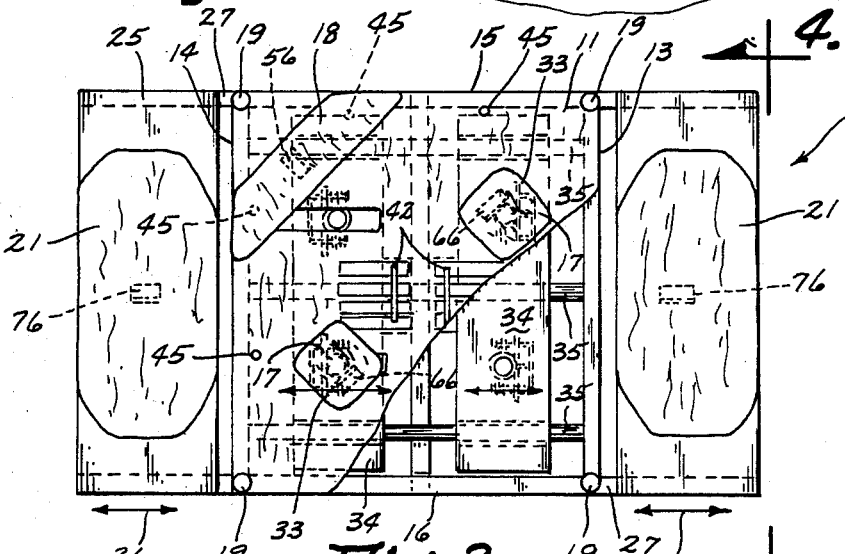
FIG. 2 is a top plan view of the main portion of the present invention shown set up for a right-handed contest and having a portion broken away to show an adjustment mechanism for the elbow pads.

Elbow pads (17) are supported in opposite corners on top of the frame (11) and are set up for a right-handed contest as shown in FIG. 2. Targets (18) are mounted on top of the frame (11) across from each other on opposite corners from the elbow pads (17).

Seats (21) are disposed adjacent to the ends (13) (14) for permitting two contestants to sit thereon and utilize the apparatus (10) while having room between the support members (12) for the legs of the contestants.

To utilize the apparatus (10) as shown in the preferred embodiment, a first contestant would sit on one of the seats (21) and another contestant would sit on the other seat (21). Vertical adjustment mechanisms (22) on the seat legs (23) would be utilized to cause the level of the shoulders of both contestants to be at same height despite the physical differences in the contestants. The vertical adjustment mechanism (22) is in all material respects identical to the mechanism (32) shown in FIGS. 7 and 8 for adjusting the vertical position of the elbow pads (17).

Figure 4:
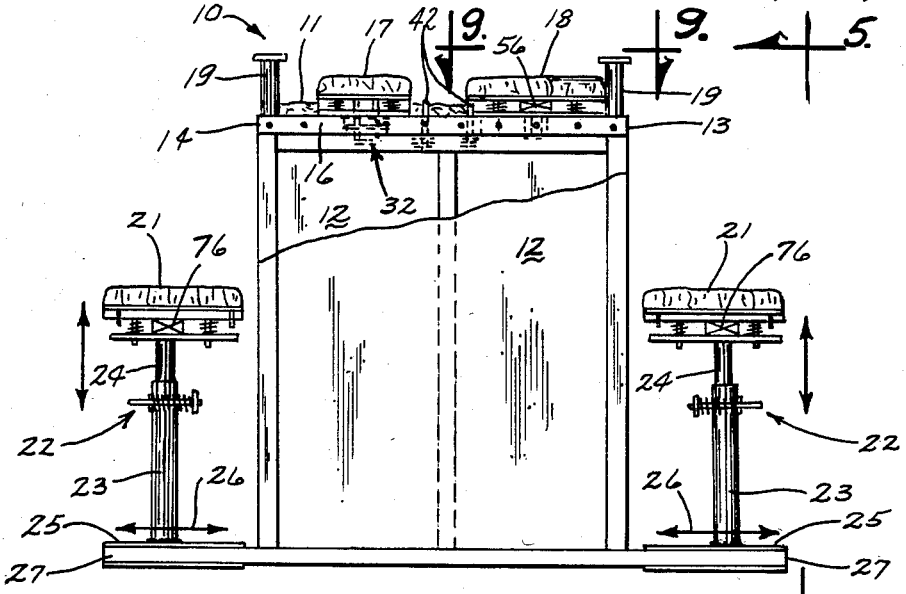
FIG. 4 is a side elevational view from one end taken along line 4—4 of FIG. 2.
Figure 5:
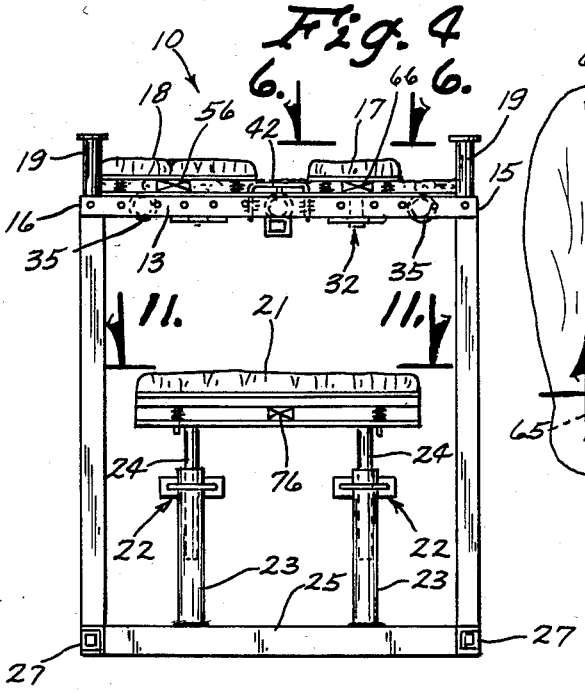
FIG. 5 is a side elevational view taken along line 5—5 of FIGS. 2 and 4.
Figure 6:
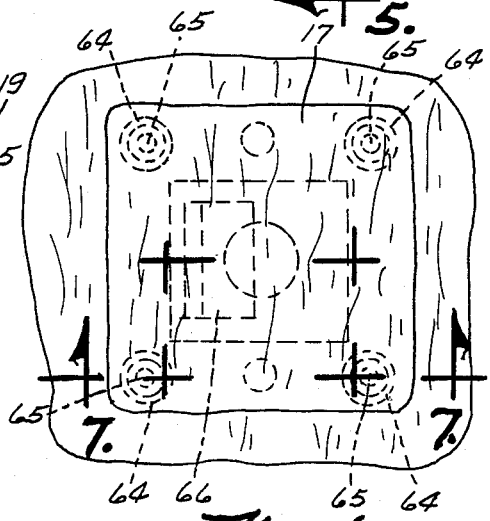
FIG. 6 is an enlarged top view of one of the elbow pads taken along line 6—6 of FIG. 5.

Referring to FIG. 4, it is noted that the seats (21) can also be moved toward or away from the ends (13) and (14) in the direction of the arrows (26). Member (25) merely slides over the tubing (27) in a telescoping fashion and can easily be adjusted inwardly or outwardly to accommodate the physical size of each individual contestant.

The contestants would then place their right elbows onto the pads (17) as shown in FIGS. 1 and 2, for example. The contestants would then grasp their right hands together, and grasp handles (19) with their left hands. If one or the other of the right hands is shorter than the other, then the pad (17) underneath the person with the shorter arm would be raised upwardly, for example by the mechanism (32) shown in FIG. 7 wherein compression springs (28) push a bent rod (29) and a pin (30) into any one of a number of openings, shown in dashed lines in FIGS. 7 and 8, in a shaft (31). The shaft (31) is vertically disposed and is connected to a pad structure (17) at the top thereof. Additionally, the pads (17) can be moved in the direction of the arrows (33) shown in FIG. 2 to prevent the pad (17) to be adjusted closer to or farther from each individual contestant so that neither contestant will have an unfair advantage over the other one in this regard. Adjusting mechanisms (34) are slidably disposed on rods (35) and a holding mechanism and adjusting mechanism (42) permits the member (34) to be moved in the directions fore or aft of the arrow (33). By grasping the handle of the mechanism (42), lifting it upwardly and then pulling it backwardly, the member (34) and thereby the pad (17) which is connected thereto will move back towards the contestant. Alternatively such member (34) and pad (17) can be moved in an opposite direction. The holding mechanism (42) is constructed like the mechanism (32) shown in FIG. 8.

Figure 3:
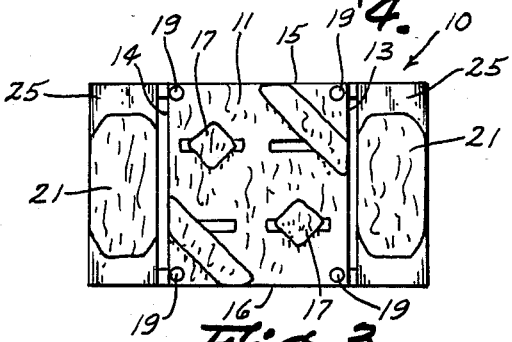
FIG. 3 is a top plan view of the present invention set up for a left-handed contest, as contrasted with the right-handed arrangement shown in FIG. 2.
Figure 7:
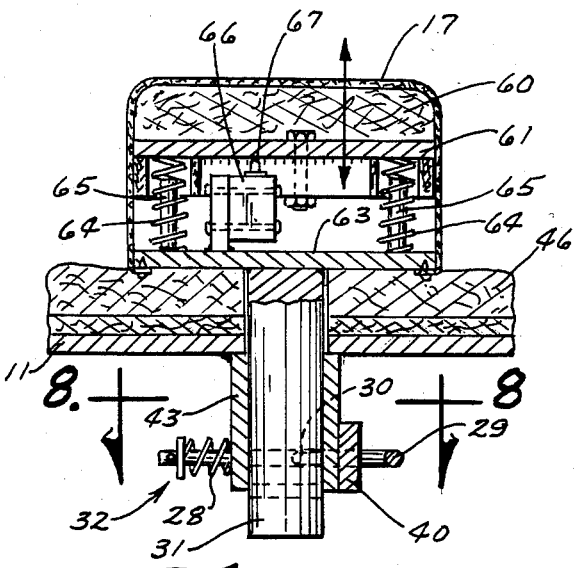
FIG. 7 is a cross sectional view of one of the elbow pads taken along line 7—7 of FIG. 6.
Figure 8:
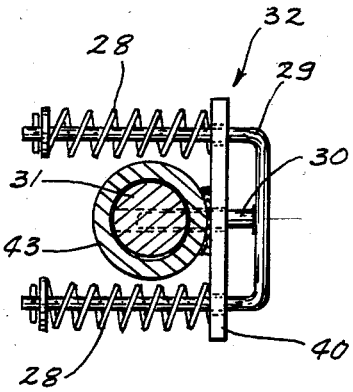
FIG. 8 is a cross sectional view of vertical adjusting mechanisms for an elbow pad as taken along line 8—8 of FIG. 7.

Referring to FIG. 3, it is noted that the pads (17) can be moved to the other corners to accommodate a left-handed contest by merely pulling the shaft (31) up and out from the cylinder (43), as shown in FIGS. 7 and 8, after the pin (30) has been pulled out from one of the openings of the shaft (31). Then the pad (17) can be placed in a corresponding cylinder (43) on the left side of each contestant, in the position shown in FIG. 3.

Similarly, the targets (18) are held in place by pins (44) which are received into openings (45) in the frame (11) and through a pad (46) disposed on top thereof. Since there are openings on each of the corners of the frame (11), these targets (18) can merely be lifted up out of one side and placed into the openings (45) on opposite corners. Basically, the arrangement of the elbow pads (17) and targets (18) as shown in FIG. 2 are merely rotated ninety degrees from the position shown in FIG. 2 to achieve the left-handed set up as shown in FIG. 3.

Figure 9:
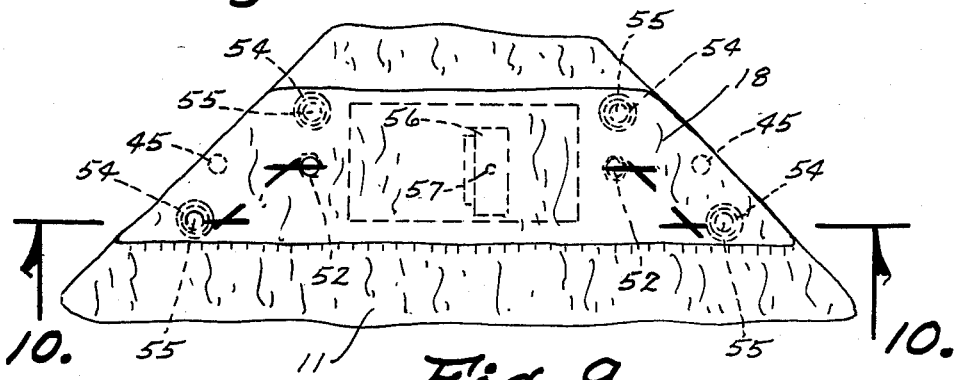
FIG. 9 is an enlarged top plan view of one of the win targets taken along line 9—9 of FIG. 4.
Figure 10:
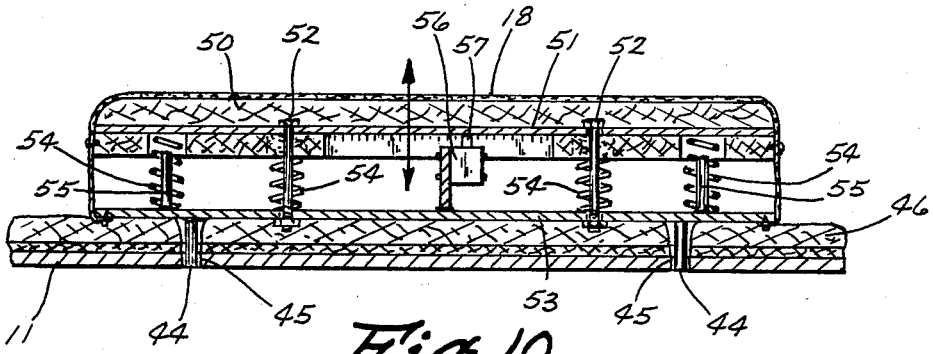
FIG. 10 is a cross sectional view of a win target taken along line 10—10 of FIG. 9.

The targets (18) as shown in FIGS. 9 and 10 include padding (50) and a structural frame (51). A plurality of bolts (52) attach the plate (51) to a bottom plate (53). Compression springs (54) are provided for biasing the plate (51) upwardly to the position shown in FIG. 10, and stop pins (55) are connected to the lower plate (53) and are provided for making sure that the plate (51) will not move downwardly beyond the top of a normally open switch (56), to prevent damage to the switch (56).

When the target (18) is pushed downwardly to an extent that the button (57) is depressed, this action will close the switch (56) and cause the win light (59) to light up. A buzzer, or other sound actuated device, can also be electrically connected in conjunction with the win light (59), if desired. A spring (not shown) is provided within the switch body (56) for biasing the switch (56) open and biasing the actuator button (57) upwardly to the position shown in FIGS. 10 and 13.

Figure 13:
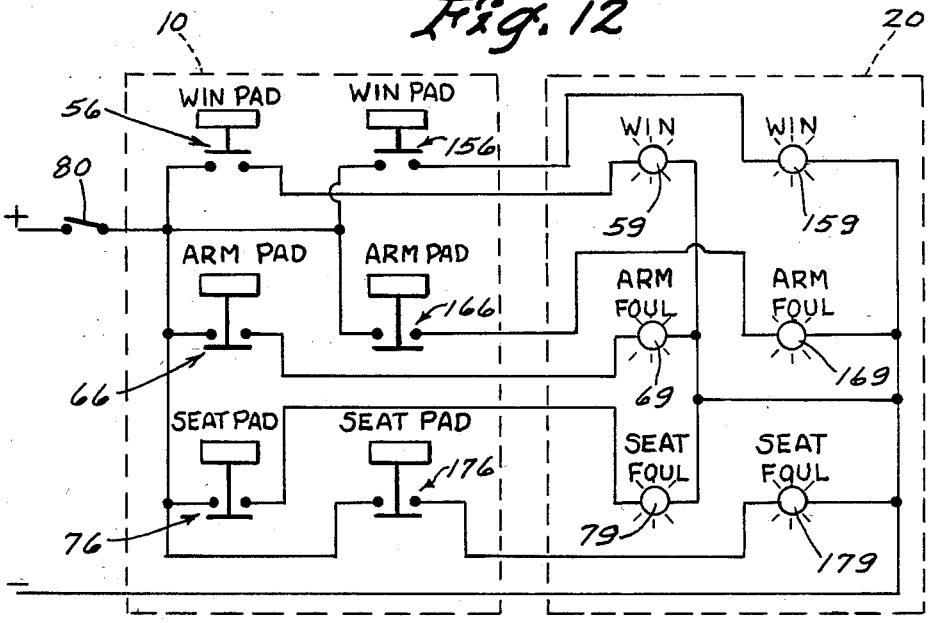
FIG. 13 is a schematic view of the electric circuit of the preferred embodiment of the present invention.

In the schematic diagram of FIG. 13 it is noted that a second win pad switch has been numbered (156) and the second contestant's win light numbered (159) to avoid confusion, even though these elements are identical in structure to win pad switch (56) and win light (59) respectively, because they form a separate part of the circuit of FIG. 13.

One of the rules in the proposed contest is that neither contestant can lift his elbow upwardly off of his own pad (17), because that would give him an unfair advantage over his opponent. Looking to FIG. 7 it is noted that each of the elbow pads (17) have a padding (60) and a rigid frame (61). A switch body (66) is rigidly secured to a lower plate (63) and a pair of stop pins (65) are rigidly connected to lower plate (63). Compression springs (64) are provided around the stop pins (65) for biasing the pads (17) and the upper plate (61) upwardly. In the position shown in FIG. 7, a switch actuator button (67) is biased upwardly to the position shown in FIG. 7, and in such position the normally closed switch (66) would light up the foul arm light (69).

When a contestant has his elbow properly on the pad (17), the button (67) will be depressed and the switch (66) will be open and the arm foul light (69) will be off.

A similar condition will of course exist when the other arm pad switch (166), as shown in FIG. 13, is being utilized by the other contestant. If, at any time during the course of the contest, one of the contestants lifts his elbow up from the pad (17), the button (67) will move upwardly by the bias within the switch (66), the switch (66) will close, the arm foul light will go on and the contestant will be warned or disqualified, depending upon the rules set for that particular contest.

Figure 11:
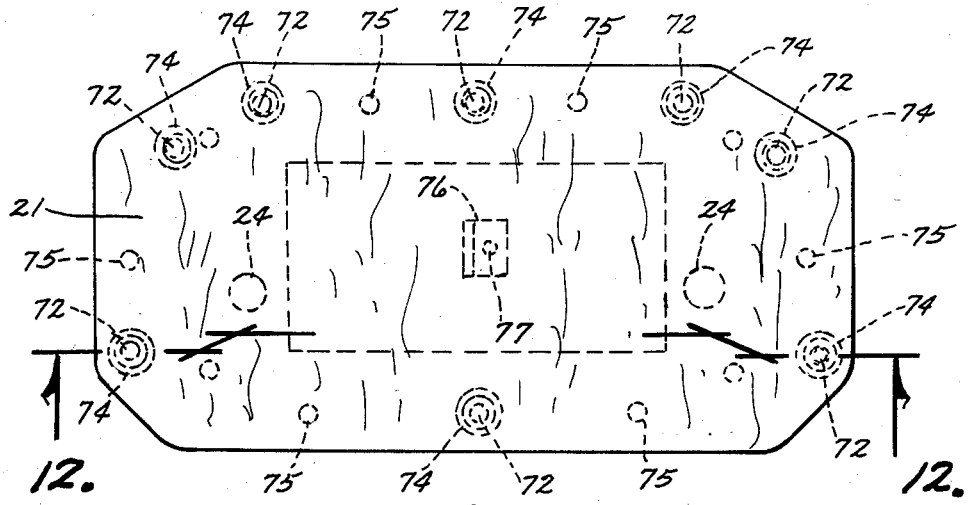
FIG. 11 is an enlarged top plan view of one of the seats as taken along line 11—11 of FIG. 5.
Figure 12:
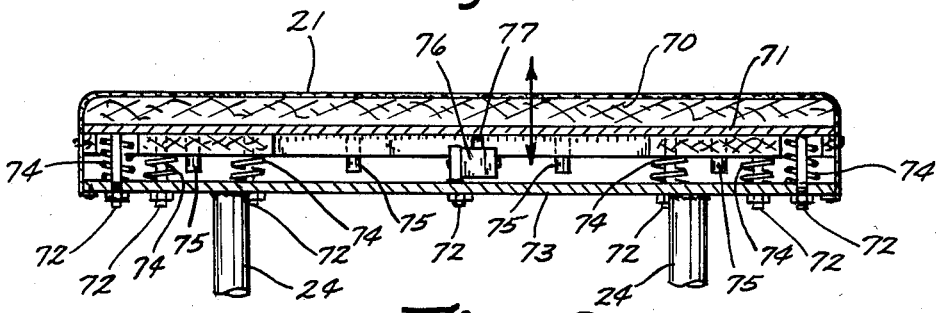
FIG. 12 is a cross sectional view of the seat of FIG. 11 taken along line 12—12 of FIG. 11.

Referring now to the seat (21) as shown in FIGS. 11 and 12, it is noted that padding (70) is provided below the vinyl cover of the seat (21) and an upper plate (71) is utilized to support the padding (17). A plurality of nut and bolt structures (72) are utilized to interconnect the upper plate (71) with the lower plate (73). A plurality of coil springs (74) are utilized to bias the upper plate (71) and thereby the seat (21), to the upward position shown in FIG. 12. Stop pins (75) are provided for preventing the top plate (71) from moving down so far as to damage a switch (76), which is rigidly attached to the lower plate (73). A button (77), associated with the switch (76), is biased upwardly to the position shown in FIG. 12. This switch (76) is like the switch (66) in the elbow pad (17), in that it is a normally closed switch which will cause the seat foul light (79) to go on when it is in the position shown in FIG. 12.

Because a contestant will have an unfair advantage over his opponent if he lifts the weight of his body up off of the seat (21), a seat foul light (79) is provided. So long as the respective contestant remains seated on his respective seat (21), the button (77) will be moved downwardly against the bias thereon and the switch (76) will remain open and the seat foul light (79) off. So long as each contestant remains seated upon his own respective seat (21), the seat foul light lights (79) or (179) will not be on; but if one or the other of the contestants takes his weight off of his seat (21) to an extent that the upper plate (71) moves to the position shown in FIG. 12 and the button (77) to the position shown in FIG. 12, then the respective switch (76) or (176) will be at its normally closed position and the respective seat foul light will go on.

Referring again to FIG. 1 it is noted that a housing (20) is provided for the win, arm foul, and seat foul lights and is to be further understood that audio signals could be connected to any one or all of such lights. A power cord (81) extends from the housing (20) so that such circuit shown in FIG. 13 can receive power from an ordinary household electrical outlet.

Referring again to FIG. 13 it is noted that the arrows shown in the schematic for switches (56) and (156) are for indicating that these switches (56) and (156) are biased to a normally open position. Similarly the arrows in FIG. 13 associated with switches (66), (166), (76) and (176) are for indicating that switches (66), (166), (76) and (176) are biased to a normally closed position.

Accordingly it will be appreciated from the above description of the preferred embodiment (10) of the present invention that all of the aforementioned objects are achieved by use of such preferred embodiment (10). Obviously many modifications and variations of the present invention are possible in light of the above teachings. It is therefore to be understood that, within the scope of the appended claims, the invention may be practiced otherwise than as specifically described.

I claim:

1. An arm wrestling apparatus comprising:

a frame having a first end, a second end, a first side, a second side, a top and a bottom;

means operably attached to said frame for supporting said frame in an elevated position;

first pad means operably attached to the top of said frame for receivably supporting an elbow of a first person positioned near said first end of said frame, said first pad means being positioned nearer to said first end and said first side of the frame than to the second end and the second side thereof respectively;

second pad means operably attached to the top of said frame for receivably supporting an elbow of a second person positioned near said second end of said frame, said second pad means being positioned nearer to said second end and said second side of the frame than to the first end and second side thereof respectively;

means associated with said first pad means for indicating when the first person's elbow is lifted off of the first pad means and means associated with said second pad means for indicating when the second person's elbow is lifted off of said second pad means;

means for selectively and independently adjusting the vertical level of said first and second pad means;

means for selectively and independently adjusting the distance of said first and second pad means from a center line of the frame which extends between the ends thereof and intersects the sides thereof and which defines an imaginary boundary line between two halves of the frame;

first target means operably disposed on top of said frame for abutting with the hand of said second person for determining when said first person has won an arm wrestling contest, said first target means being positioned nearer to said first end and said second side of the frame than to the second end and first side thereof respectively;

second target means operably disposed on top of said frame for abutting with the hand of said first person for determining when said second person has won an arm wrestling contest, said second target means being positioned nearer to said second end and said first side of the frame than to the first end and second side thereof respectively, whereby the loser's arm will be bent backwardly in a safe direction conforming to a natural bending action for human arms;

first electric means associated with said first target means for indicating that the first person has won when the first person forces the hand of the second person against the first target means and second electric means associated with said second target means for indicating that the second person has won when the second person forces the hand of the first person against the second target means;

first seat means disposed adjacent to said first end of said frame for seating the first person, and second seat means disposed adjacent to said second end of said frame for seating the second person;

means associated with said first seat means for indicating when the first person is no longer sitting on said first seat means and means associated with said second seat means for indicating when the second person is no longer sitting on said second seat means;

first vertical adjusting means for selectively adjusting the vertical position of said first seat means and second vertical adjusting means for selectively adjusting the vertical position of said second seat means; and first horizontal adjusting means for selectively adjusting the horizontal distance of said first seat means from the first end of the frame and second horizontal adjusting means for selectively adjusting the horizontal distance of said second seat means from the second end of the frame.

2. The arm wrestling apparatus of claim 1 including means for permitting said first pad means, second pad means, first target means and second target means to be rearranged on said frame to accommodate either a left handed contest or a right handed contest while still maintaining a safe bending relationship for the arms of the contestants.

3. The arm wrestling apparatus of claim 1 wherein said first target means overlies a central edge of said second side.

4. The arm wrestling apparatus of claim 3 wherein said second target means overlies a central edge of said second side.

* * * * *